US011105499B2

(12) United States Patent
Loschkin et al.

(10) Patent No.: US 11,105,499 B2
(45) Date of Patent: Aug. 31, 2021

(54) HEAT RECOVERY SURFACES ARRANGEMENT IN A RECOVERY BOILER

(71) Applicant: ANDRITZ OY, Helsinki (FI)

(72) Inventors: Miro Loschkin, Kotka (FI); Jukka Röppänen, Helsinki (FI)

(73) Assignee: Andritz Oy, Helsinki (FI)

( * ) Notice: Subject to any disclaimer, the term of this patent is extended or adjusted under 35 U.S.C. 154(b) by 387 days.

(21) Appl. No.: 15/759,620

(22) PCT Filed: Sep. 13, 2016

(86) PCT No.: PCT/FI2016/050631
§ 371 (c)(1),
(2) Date: Mar. 13, 2018

(87) PCT Pub. No.: WO2017/046450
PCT Pub. Date: Mar. 23, 2017

(65) Prior Publication Data

US 2018/0313531 A1 Nov. 1, 2018

(30) Foreign Application Priority Data

Sep. 14, 2015 (FI) ..... 20155658

(51) Int. Cl.
*F22B 21/00* (2006.01)
*F22G 7/14* (2006.01)
(Continued)

(52) U.S. Cl.
CPC ..... *F22B 21/002* (2013.01); *F22B 31/04* (2013.01); *F22G 5/10* (2013.01); *F22G 7/12* (2013.01); *F22G 7/14* (2013.01); *D21C 11/12* (2013.01)

(58) Field of Classification Search
CPC ..... F22B 21/002; F22B 31/04; F22G 7/14; F22G 7/12; F22G 5/10; D21C 11/12
(Continued)

(56) References Cited

U.S. PATENT DOCUMENTS 3,324,837 A 6/1967 Gorzegno et al.
5,299,534 A * 4/1994 Janka ..... F22G 7/14 122/20 B
(Continued)

FOREIGN PATENT DOCUMENTS

EP 1 188 986 3/2002
EP 1188986 A2 * 3/2002
(Continued)

OTHER PUBLICATIONS

U.S. Appl. No. 15/759,620, filed Mar. 13, 2018.
(Continued)

*Primary Examiner* — Steven B McAllister
*Assistant Examiner* — Benjamin W Johnson
(74) *Attorney, Agent, or Firm* — Nixon & Vanderhye P.C.

(57) ABSTRACT

An arrangement in a recovery boiler having a furnace for combusting waste liquor and a flue gas duct comprising vertical flue gas channels, at least part of which is provided with heat recovery units for recovering heat from flue gases. The heat recovery units have a width of substantially the width of the flue gas duct, whereby downstream of the furnace the first flue gas channel is provided with a superheater. In addition to the superheater, the first flue gas channel is provided with one of following heat recovery units: an economizer, a boiler bank, or a reheater. The superheater and a second heat recovery unit are located one after the other in horizontal introduction direction of the flue gas, so that in a flue gas channel the flue gas flows in the
(Continued)

vertical direction downwards and heats the superheater and the second heat recovery unit simultaneously.

19 Claims, 7 Drawing Sheets

(51) Int. Cl.
*F22G 7/12* (2006.01)
*F22G 5/10* (2006.01)
*F22B 31/04* (2006.01)
*D21C 11/12* (2006.01)

(58) Field of Classification Search
USPC ..... 122/235.11
See application file for complete search history.

(56) References Cited

U.S. PATENT DOCUMENTS 5,950,574 A * 9/1999 Matsuda ..... F22G 7/14 122/460
7,587,994 B2 * 9/2009 Raukola ..... D21C 11/12 122/7 R
7,640,750 B2 1/2010 Saviharju et al.
8,443,606 B2 5/2013 Monacelli et al.
2012/0102955 A1 5/2012 Yamamoto et al.

FOREIGN PATENT DOCUMENTS

| | | | |
|---|---|---|---|
| EP | 1 728 919 | | 12/2006 |
| GB | 430556 | | 6/1935 |
| JP | 08-82405 | | 3/1996 |
| JP | H0882405 | A * | 3/1996 |
| RU | 2057985 | | 4/1996 |
| RU | 2126472 | | 2/1999 |
| RU | 21439 | | 1/2002 |
| SU | 612105 | | 6/1978 |
| WO | WO 2014/044911 | | 3/2014 |
| WO | WO 2015/083253 | | 6/2015 |

OTHER PUBLICATIONS

International Search Report for PCT/FI2016/050631, dated Jan. 16, 2017, 2 pages.
Written Opinion of the ISA for PCT/FI2016/050631, dated Jan. 16, 2017, 6 pages.
Decision to Grant in RU 2018113429 dated Nov. 16, 2020, 13 pages (with Russian to English machine translation).

* cited by examiner

HEAT RECOVERY SURFACES ARRANGEMENT IN A RECOVERY BOILER

This application is the U.S. national phase of International Application PCT/FI2016/050631 filed Sep. 13, 2016, which designated the U.S. and claims priority to Finnish Patent Application 20155658 filed Sep. 14, 2015, the entire contents of each of which are incorporated by reference.

OBJECT OF THE INVENTION

The present invention relates to a recovery boiler, especially to an arrangement for recovering heat of flue gases generated in the combustion of waste liquor, such as black liquor, of the chemical pulping industry.

BACKGROUND OF THE INVENTION

In the manufacture of chemical pulp, lignin and other organic non-cellulosic material is separated from the raw material of chemical pulp by cooking using cooking chemicals. Cooking liquor used in chemical digestion, i.e. waste liquor is recovered. The waste liquor, which is separated mechanically from the chemical pulp, has a high combustion value due to carbonaceous and other organic, combustible material contained therein and separated from the chemical pulp. The waste liquor also contains inorganic chemicals, which do not react in chemical digestion. Several different methods have been developed for recovering heat and chemicals from waste liquor.

Black liquor obtained in sulfate pulp production is combusted in a recovery boiler. As the organic and carbonaceous materials contained in black liquor burn, inorganic components in the waste liquor are converted into chemicals, which can be recycled and further utilized in the cooking process.

Hot flue gases are generated in black liquor combustion, which are led into contact with various heat transfer devices of the recovery boiler. Flue gas conveys heat into water or vapor, or a mixture of water and vapor, flowing inside the heat exchangers, simultaneously cooling it. Usually the flue gases contains ash in abundance. A main part of the ash is sodium sulfate, and the next largest part is usually sodium carbonate. Ash contains other components, too. The ash entrained in flue gases is in the furnace mainly in vaporized form, and starts to convert into fine dust or smelt droplets mainly in part of the boiler downstream of the furnace. The salts contained in the ash melt, or they are sticky particles even at relatively low temperatures. Molten and sticky particles stick easily onto heat transfer surfaces and even corrode them. Deposits of sticky ash have caused a clogging risk of the flue gas ducts, and also corrosion and wearing of the heat surfaces in the boiler.

A waste liquor recovery boiler is conventionally formed of the following main parts, which are illustrated schematically in FIG. 1:

The furnace of a recovery boiler comprises a front wall and side walls. The width of the furnace refers to the horizontal length of the front wall and the depth refers to the length of the side wall of the furnace. FIG. 1 illustrates the structure of a recovery boiler having a furnace defined by water tube walls, a front wall 11, side walls 16 and a rear wall 10, and also a bottom 15 formed of water tubes. Combustion air is fed into the furnace from multiple different levels. Waste liquor, such as black liquor, is fed from nozzles 12. During combustion, a smelt bed is formed onto the bottom of the furnace.

A lower part 1 of the furnace, where combustion of waste liquor mainly takes place.

A middle part 2 of the furnace, where the final combustion of gaseous combustible substances mainly takes place.

An upper part 3 of the furnace

A superheater zone 4, wherein the saturated steam exiting the steam drum 7 is converted into (superheated) steam having a higher temperature. In the superheater zone or in front of it there is often a so-called screen tube surface or screen tubes, which usually acts as a water reboiler.

in a flue gas duct following the furnace are the heat exchangers downstream of the superheaters: a boiler bank and economizers, wherein the heat of flue gas generated in the furnace is recovered. The boiler bank 5, i.e. water vaporizer, is located in the first flue gas pass of the flue gas duct, i.e. in a so-called second pass. In the boiler bank the water at a saturated temperature is partly boiled into vapor.

Feed water preheaters, i.e. so-called economizers 6*a*, 6*b*, wherein the feed water flowing in the heat transfer elements is preheated by means of flue gases prior to leading the water into the drum 7 and into the steam-generating parts (boiler bank 5, walls of the furnace and possible screen tubes) and into superheating parts 4 of the boiler.

A drum (or steam drum) 7 having water in the lower part and saturated steam in the upper part. Some boilers have two drums: a steam drum (upper drum) and a water drum (lower drum), where between a heat transfer device, so-called boiler bank tubes for boiling the water are provided.

Other parts and devices in conjunction with the boiler, such as e.g. a combustion air system, a flue gas system, a liquor feeding system, a treatment system for smelt and liquor, feed water pumps etc. A so-called nose is marked with reference numeral 13.

The water/steam circulation of the boiler is arranged via natural circulation, whereby the water/steam mixture formed in the water tubes of the walls and bottom of the furnace rises upwards via collection tubes into a steam drum 7 that is located crosswise in relation to the boiler, i.e. parallel to the front wall 11. Hot water flows from the steam drum via downcomers 14 into a manifold of the bottom 15, wherefrom the water is distributed into the bottom water tubes and further into the water tube walls.

The preheater i.e. economizer typically refers to a heat exchanger comprising heat transfer elements, inside which the boiler feed water to be heated flows. Free space for flue gas flow remains in the economizer between the heat transfer elements. As the flue gas passes by the heat transfer elements, heat is transferred into the feed water flowing inside the elements. The boiler bank is also formed of heat transfer elements, inside which the water to be boiled or a mixture of water and steam flows, into which the heat is transferred from the flue gas flowing pass the elements.

The heat exchangers, i.e. boiler bank and economizers, are usually constructed so that in them the flue gas flows not from below upwards, but usually only from above downwards. In economizers, the flow direction of water is usually opposite to the flow direction of flue gases in order to provide a more economical heat recovery.

In some waste liquor recovery boilers the boiler bank is constructed such that the flue gases flow substantially horizontally. In single drum boilers having such a horizontal boiler bank, the heat transfer elements of the boiler bank are positioned so that the water to be boiled flow substantially from down upwards. The boiler bank here is referred to as a horizontal boiler bank because the flue gases flow substantially horizontally. Two drum boilers are usually provided with a typical upper drum and a lower drum, between which the boiler bank tubes are located so that the water to be boiled flows in the tubes substantially from down upwards and the flue gases flow substantially horizontally. In these cases, a common term cross-flow can be used for the flue gas and water streams, or a term cross-flow boiler bank for the boiler bank.

In a conventional waste liquor recovery boiler illustrated schematically in FIG. 1, which has a so-called vertical flow boiler bank 5, the flue gases flow vertically from above downwards. A flow channel 8 for flue gases is arranged adjacent to the boiler bank, in which channel the flue gases that have flown through the boiler bank 5 flow from down upwards. The channel 8 is as conventional devoid of heat transfer devices. Next to the channel 8 there is a first economizer (a so-called hotter economizer) 6*a*, wherein the flue gases flow from above downwards, transferring heat into the feed water that flows in the heat transfer elements of the economizer. In a corresponding way, a second flue gas channel 9 is arranged next to the economizer, in which channel the flue gases coming from the lower end of the economizer 6*a* flow upwards. Also this flue gas channel is, as conventional, a substantially empty channel without heat transfer elements for heat recovery or water preheaters. Next to the flue gas channel 9 is a second economizer, a so-called colder economizer 6*b*, in which the flue gases flow from above downwards, heating the feed water flowing in the heat transfer elements.

In addition to the boiler bank 5, two economizers 6*a* and 6*b* and the channels 8, 9 between them, the boiler can have several corresponding flue gas channels and economizers.

As is known, the flue gases on the boiler bank and the economizers are arranged to flow from above downwards. The ash entrained in the flue gases fouls the heat transfer surfaces. As ash particles stick onto the heat transfer surfaces, the ash layer gradually gets thicker, which impairs heat transfer. If ash accumulates abundantly on the surfaces, the flow resistance of the flue gas can grow into a disturbing level. Heat transfer surfaces are cleaned with steam blowers, via which steam is from time to time blown onto the heat transfer surfaces, whereby the ash accumulated onto the surfaces is made to come loose and pass with the flue gases into ash collection hoppers located in the lower part of the heat transfer surface.

Not all recovery boilers are provided with a boiler bank. European patent application 1188986 presents a solution, in which the first flue gas duct part downstream of the recovery boiler, the so-called second pass, is provided with at least one superheater, especially a primary superheater. Then a problem can be excess increase of the temperatures of surfaces in this part of the flue gas duct. WO patent application 2014044911 presents that said part of the flue gas duct is arranged for being cooled with cooling medium coming from the screen tubes.

European patent 1728919 presents an arrangement, where the part of the flue gas duct, the so-called second pass, is provided with both a boiler bank and an economizer one after the other in the incoming direction of the flue gas, but the superheater surfaces are located, corresponding to prior art, in the upper part of the furnace of the boiler. When the second pass is provided with a boiler bank and an economizer, it limits the positioning of other heat surfaces, such as a superheater surface, in the flue gas flow.

BRIEF DESCRIPTION OF THE INVENTION

If the aim is to increase the superheater surface of a boiler, the height of the boiler building is to be increased correspondingly. Therefore, it is advantageous to arrange additional superheating surface in the so-called second pass of the flue gas duct, since this decreases the need to enlarge the boiler building. An object of the present invention is to provide a more flexible solution than earlier for modifying the size and positioning of various heat recovery surfaces of a recovery boiler in accordance with the needs of the process.

The invention relates to an arrangement in a recovery boiler having a furnace for combusting waste liquor and a flue gas duct comprising vertical flue gas channels, at least part of which is provided with heat recovery units for recovering heat from flue gases. The heat recovery units have a width substantially the same as the width of the flue gas duct, whereby downstream of the furnace the first flue gas channel is provided with a superheater. The arrangement is characterized in that in addition to the superheater, the first glue gas channel, the so-called second pass, is provided with one of following heat recovery units: an economizer, a boiler bank, or a reheater. The superheater and a second heat recovery unit are located parallel so that in a flue gas channel the flue gas flows in the vertical direction from above downwards and heats the superheater and the second heat recovery unit simultaneously. With respect to the horizontal flow direction of the flue gas the superheater and the second heat recovery unit are located one after the other. The superheater and the second heat recovery unit, i.e. economizer, boiler bank or reheater typically have the width equal to that of the flue gas duct (i.e. of the length of the front and rear wall of the furnace). Each heat recovery unit, i.e. superheater, reheater, economizer and boiler bank, is formed of a number of heat recovery elements.

A superheater, a reheater, a boiler bank and an economizer refer to heat recovery units, which are formed of heat exchange elements, typically tubes, inside which the water, steam or their mixture to be heated flows. Free space for flue gas flow remains between the heat transfer elements. As the flue gas passes by the heat transfer elements, heat is transferred into the water or steam flowing inside the elements.

The flue gas flowing downwards in the flue gas channel heats the superheater and the second heat transfer unit simultaneously, whereby the flue at a certain temperature heats simultaneously both the superheater and the second heat transfer unit.

It is worth mentioning that the reheater and the superheater are in principle and in practice similar heat transfer surfaces. A difference is that in "actual" superheaters (which is this patent application is called a superheater) saturated steam exiting a boiler drum is superheated step by step to a hotter temperature (e.g. to a temperature of approximately 515° C.), until after the last step it is called live steam. The live steam is then led into a steam turbine for production of electrical energy. In a reheater, in its turn, steam obtained from a turbine is heated and after that returned back into the turbine. Bled steams are taken from the turbine at predetermined pressure levels and they are used e.g. for heating the feed water or combustion airs. When using a reheater, the steam remaining in the final end of the turbine is led back into the boiler, into a reheater, where the steam is heated and the heated steam is taken back into the turbine for improving the production of electricity. The invention also relates to an arrangement in a recovery boiler having a furnace for combusting waste liquor and a flue gas duct comprising vertical flue gas channels, at least part of which is provided with heat recovery units for recovering heat from flue gases. The heat recovery units are formed of heat exchange elements, whereby downstream of the furnace the first flue gas channel is provided with a superheater. In addition to the superheater, located in the flue gas channel is one of the following heat recovery units: an economizer, a boiler bank or a reheater, and heat surface elements of the superheater and the second heat recovery unit are positioned side by side in a direction that is transverse to the horizontal incoming direction of the flue gas, and so that in the flue gas channel the flue gas flows in the vertical direction from above downwards and heats simultaneously the superheater and the second heat recovery unit that are located in parallel with respect to the flue gas. In other words, superheater elements and elements of the second heat recovery unit are located staggered in a row that is transverse with respect to the horizontal incoming direction of the flue gas and also parallel to the front wall/rear wall of the boiler. For example, every second heat surface element can be a superheater element and every second an economizer element, or a boiler bank element or a reheater element. However, the number of superheater elements and elements of the second heat recovery unit need no always be equal, but their ratio is determined according to need.

Flue gas has in the second pass a certain maximum velocity, which in practice dictates the size of the heat surface therein, such as the number of tubes forming the heat surface, and the depth of the flue gas channel. When various heat surfaces are located in the second pass in parallel with respect to the vertical flue gas flow, their size, such as the number of tubes, can be chosen more freely, since the flue gases flow at all of them. This provides an advantage for investment costs and in the production of electricity in recovery boilers, where the best possible performance is sought by altering the mutual sizes of various heat surfaces with respect to each other, and the aim is to keep the boiler building as small as possible.

Further, the soot blowers of the second pass soot all parallel heat surfaces therein, whereby savings are obtained in the total number of the soot blowers and the consumption of sooting steam compared to a boiler wherein these are sequential surfaces located in different flue gas channels.

A further advantage is that more superheating surface can be located inside the boiler without enlarging the building, whereby higher values and amounts of superheated steam are obtained with less expenses. In that case, more superheating surface can be located behind the nose of the boiler and in the second pass, protected against radiation, whereby the corrosion rate is smaller. The superheaters in the upper part of the boiler upstream of the second pass can be made shorter, which improves the flue gas flow and efficiency of heat transfer in them. Convection heat transfer is made more efficient in the second pass by means of higher flue gas velocity, whereby savings are obtained in the investment costs of the superheaters.

According to an embodiment of the invention, a superheater and a boiler bank are located in the first flue gas channel. Typically they are positioned in the incoming direction of the flue gas, i.e. in the horizontal flow direction, one after the other so that the superheater is the first of them. The flue gas has in the boiler bank a certain maximum velocity, which in practice dictates the number of heat transfer tubes of the boiler bank and the depth of the flue gas channel. When the boiler bank is located next to the superheater, the number of tubes in the boiler bank can be chosen more freely, since the flue gases flow also at the superheater. This provides an advantage in investment costs and electricity production in recovery boilers having a smaller need for boiler bank. In present recovery boilers the dry solids of the black liquor being combusted is high (e.g. 85%) and also the pressure of live steam, e.g. 110 bar, and its temperature 510-520° C. are high, whereby the ratio of the required boiler bank with respect to the superheating surface is smaller.

According to an embodiment of the invention, a superheater and an economizer are located in the first flue gas channel, and typically they are positioned in the incoming direction of the flue gas one after the other so that the superheater is the first of them. Then the advantage is that more economizer surface can be located inside the boiler without enlarging the building, whereby the temperature of feed water can be raised higher with less expense. In that way, the space of the second pass can be effectively utilized in boilers with no need for a boiler bank.

The cooling of the second pass can advantageously be arranged so that its wall tubes are coupled with a dedicated tube circulation to a boiler drum. Then a steam/water mixture flows in the walls of the second pass. It is also possible that the cooling of the walls is performed by means of steam, whereby the wall tubes are coupled to the first superheater. In steam cooling the controlling of heat expansion of the tubes can be challenging.

According to an embodiment of the invention, a superheater and a reheater are located in the first flue gas channel. They can be positioned in the incoming direction of the flue gas sequentially so that the reheater or the superheater is the first of them. The reheater is coupled to a steam turbine, the bled steam of which the reheater heats. The steam is returned into the steam turbine at a higher temperature, whereby electricity production is increased, since the steam can be flashed in the turbine to lower pressure. The reheater of the boiler can also be two-staged. Then, the reheater of the first stage is located in the first flue gas channel (in the so-called second pass) together with a superheater. The reheater of the second stage is located in the upper part of the boiler upstream of the second pass. From the reheater of the first stage the steam flows into the reheater of the second stage and further into the turbine. Locating the reheater and superheater that is coupled to the drum of the boiler in the same flue gas channel provides a wider choice of the mutual size (number of tubes) of these heat surfaces in order to optimize the steam production of the boiler without changing the actual size of the boiler itself.

According to an embodiment of the invention, superheater elements and economizer elements are located staggered in the first flue gas channel. Thus, they are positioned side by side in a row that is crosswise with respect to the horizontal incoming direction of the flue gas. The heat surface elements can be positioned e.g. so that every second element is a superheater element and every second is an economizer element. The positioning does not need to be symmetrical. It is also possible that the number of superheater elements is higher than the number of economizer elements or vice versa. The number and size of the elements is dependent on the required heat surface according to the structure of each boiler and the process conditions.

According to an embodiment of the invention, superheater elements and boiler bank elements are located in the first flue gas channel. Thus, they are positioned side by side in a row that is crosswise with respect to the horizontal incoming direction of the flue gas. The heat surface elements can be positioned e.g. so that every second element is a superheater element and every second is a boiler bank element. The positioning does not need to be symmetrical. It is also possible that the number of superheater elements is higher than the number of boiler bank elements or vice versa. The number and size of the elements is dependent on the required heat surface according to the structure of each boiler and the process conditions.

According to an embodiment of the invention, superheater elements and reheater elements are located in the first flue gas channel. Thus, they are positioned side by side in a row that is crosswise with respect to the horizontal incoming direction of the flue gas. The heat surface elements can be positioned e.g. so that every second element is a superheater element and every second is a reheater element. The positioning does not need to be symmetrical. It is also possible that the number of superheater elements is higher than the number of reheater elements or vice versa. The number and size of the elements is dependent on the required heat surface according to the structure of each boiler and the process conditions.

A boiler bank can become unnecessary at high pressure levels of live steam and at high dry solids levels of combustion liquor. Then, also the expensive drum can be made smaller, since the requirement for phase separation capacity is smaller. If the aim is to maximize the electricity production of the cellulose pulp mill and its efficiency, an especially advantageous embodiment is a reheater as a part of the recovery boiler.

BRIEF DESCRIPTION OF THE DRAWINGS

FIGS. 2-7 use the same reference numerals as FIG. 1 where applicable.

Figure 1:
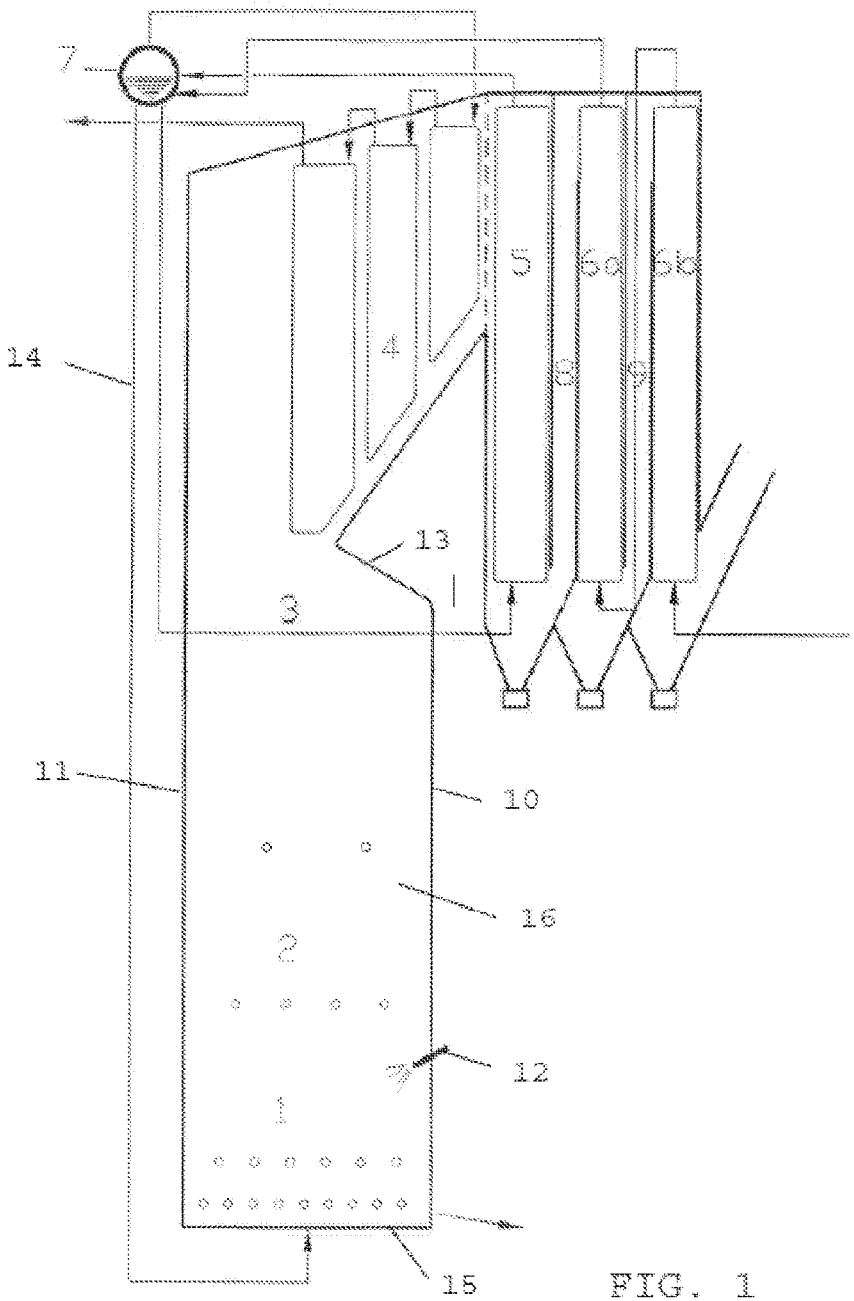
FIG. 1 (Prior Art)
FIG. 1 illustrates schematically a conventional chemical recovery boiler.
Figure 2:
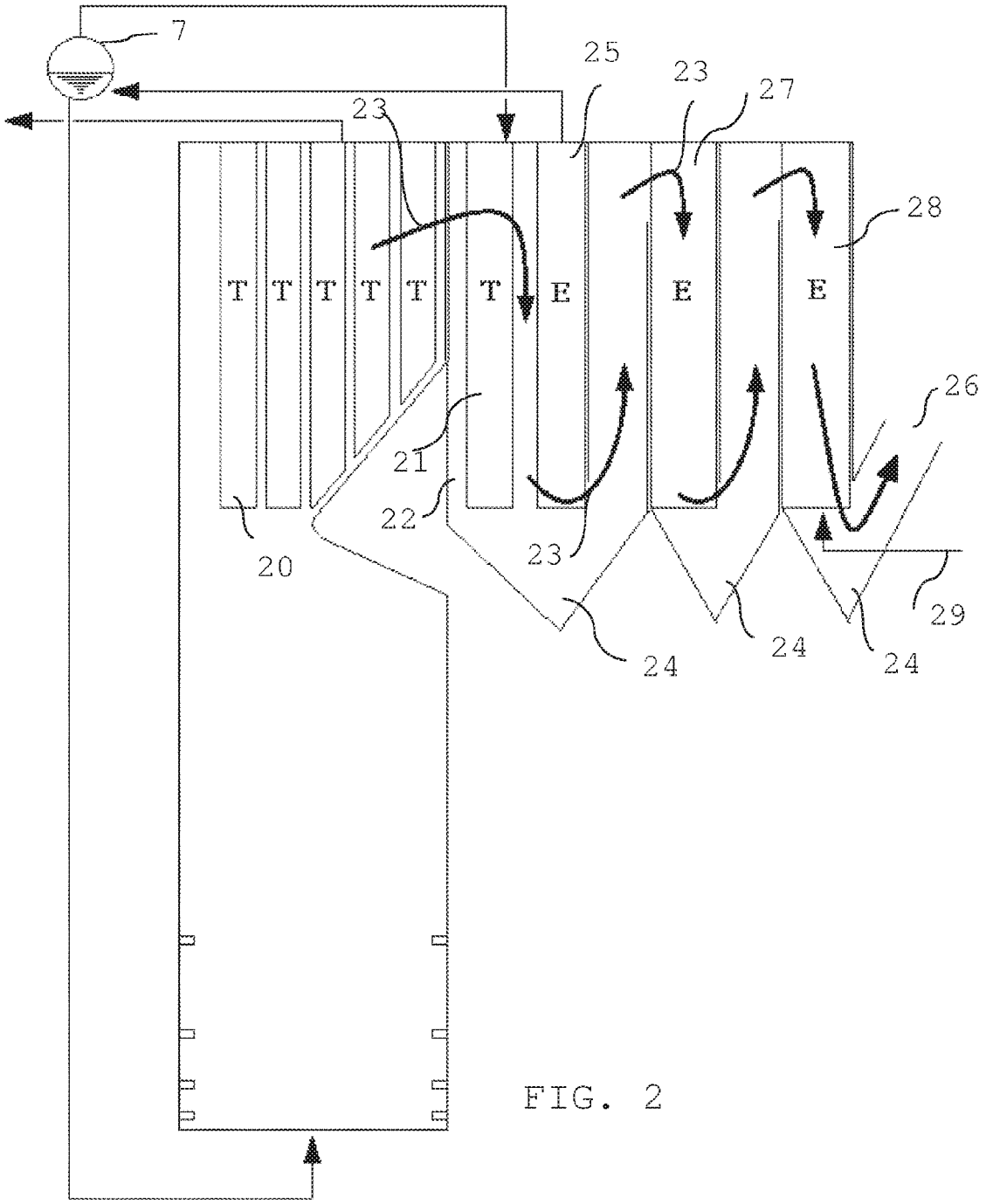
FIG. 2 illustrates a preferred embodiment of the invention, where the so-called second pass of the flue gas duct of a chemical recovery boiler is provided with a second heat recovery unit in addition to a superheater.

In the embodiment of FIG. 2 the superheaters (T) 20 of the soda recovery boiler are located in the upper part of the furnace and the superheater 21 in the so-called second pass 22. The flue gas flows pass the superheaters 20 mainly horizontally, while in the flue gas duct the flue gas flows through vertical flue gas channels in turns from above downwards and from down upwards, as shown by arrows 23. Ash hoppers 24 are provided in the lower part of the flue gas duct.

In addition to the superheater, the so-called second pass of the flue gas duct is provided with an economizer (E) 25. In the flue gas channel the flue gas flows vertically from above downwards and heats the superheater 21 and the economizer 25 simultaneously. With respect to the horizontal flow direction of the flue gas the superheater 21 and the economizer 25 are located sequentially. The superheater 21 and the economizer 25 extend typically to the whole width of the flue gas duct. The flue gas flows further through the sequential flue gas channels and exits via a discharge opening 26. In addition to the economizer 25 the flue gas duct is provided with economizers 27 and 28. The boiler water is fed into the economizers via line 29, and after it has flown countercurrently with respect to the flue gas it is led from the economizer 25 of the so-called second pass into a drum 7 of the boiler.

When the superheater and the economizer are positioned in the second pass next to each other with respect to downwards flowing flue gas, the number of their tubes can be chosen more freely, since the flue gases flow pass all the tubes. This gives an advantage when there is a need to change the mutual sizes of different heat surfaces with respect to each other and to keep the boiler building as small as possible.

Figure 3:
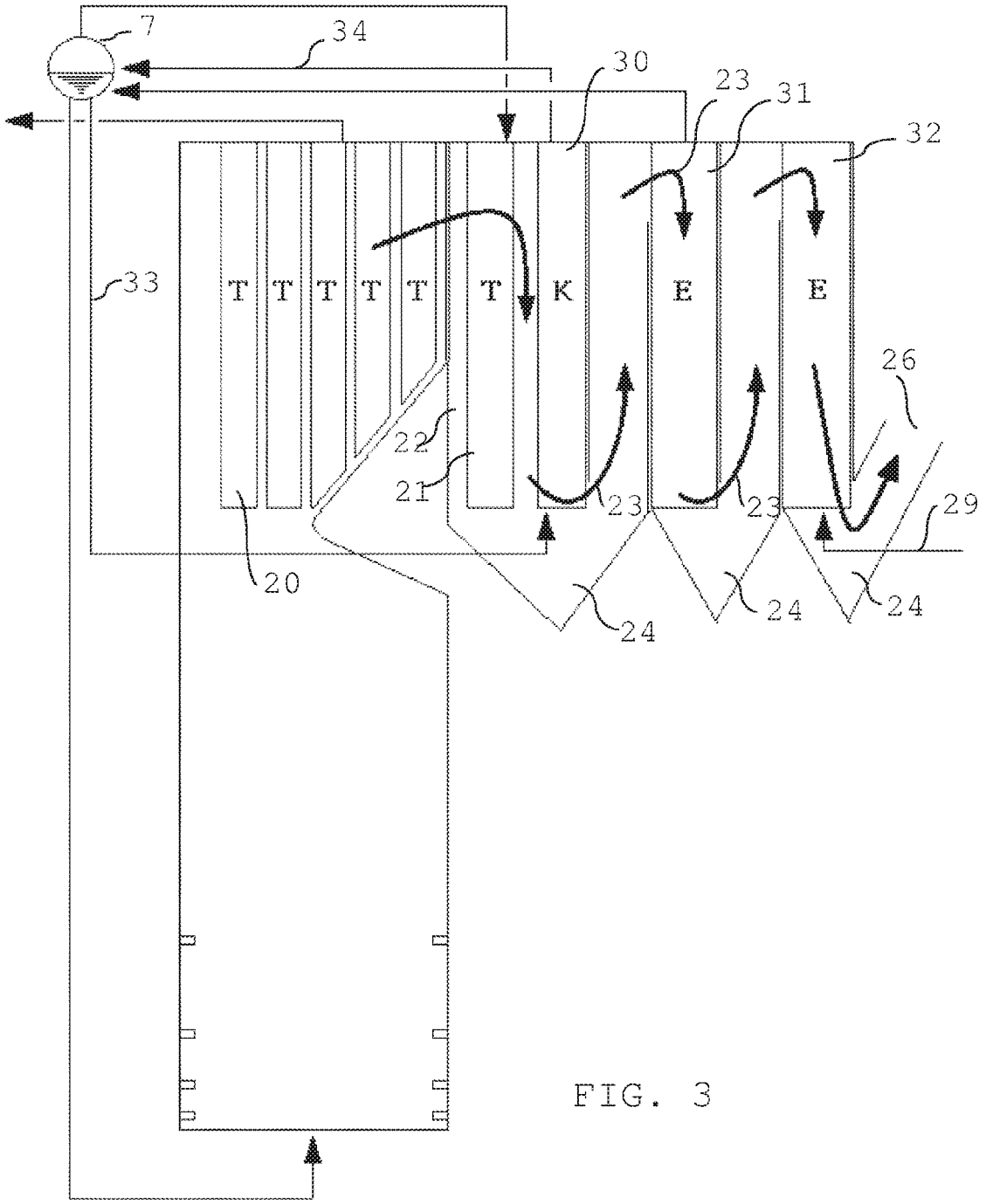
FIG. 3 illustrates a second preferred embodiment of the invention, where the so-called second pass of the flue gas duct of a chemical recovery boiler is provided with a second heat recovery unit in addition to a superheater.

The embodiment shown in FIG. 3 relates to a chemical recovery boiler where boiler bank is needed. The superheaters (T) (20) are located in the upper part of the furnace and the superheater 21 in the so-called second pass 22. The flue gas flows pass the superheaters 20 mainly horizontally, while in the flue gas duct the flue gas flows through vertical channels in turns from above downwards and from down upwards, as shown by arrows 23. Ash hoppers 24 are provided in the lower part of the flue gas duct.

In addition to the superheater, the so-called second pass of the flue gas duct is provided with a boiler bank 30. In the flue gas pass 22 the flue gas flows vertically from above downwards and heats the superheater 21 and the boiler bank 30 simultaneously. With respect to the horizontal flow direction of the flue gas the superheater 21 and the boiler bank 30 are located sequentially. The superheater 21 and the boiler bank 30 extend typically to the whole width of the flue gas duct. In the boiler bank 30 the water 33 at a saturated temperature coming from the drum 7 of the boiler is boiled partly into steam 34, which is led into the drum 7.

The flue gas flows after the second pass further through the sequential flue gas channels and exits via a discharge opening 26. The flue gas duct is additionally provided with economizers 31 and 32. The boiler water is fed into the economizers via line 29, and after it has flown countercurrently with respect to the flue gas it is led from the economizer 31 downstream of the so-called second pass into the drum 7 of the boiler.

Positioning the superheater and the boiler bank in the second pass next to each other with respect to the downwards flowing flue gas provides advantages. The flue gas has in the boiler bank a certain maximum velocity, which in practice dictates the number of tubes of the boiler bank and the depth of the flue gas channel. When the boiler bank is located next to the superheater, the number of tubes in the boiler bank can be chosen more freely, since the flue gases flow also at the superheater. This provides and advantage in investment costs and electricity production in recovery boilers having a smaller need for boiler bank. The need for a boiler bank decreases at high pressure levels of live steam and at high dry solids levels of combustion liquor. The heat efficiency needed for boiling decreases as the pressure of the steam increases, the flue gas amount decreases with dryer combustion liquor. On the other hand, the feed water needs to be heated to a higher temperature, since the higher pressure simultaneously increases the saturated temperature, whereby the size of the economizer needs to the increased.

Figure 4:
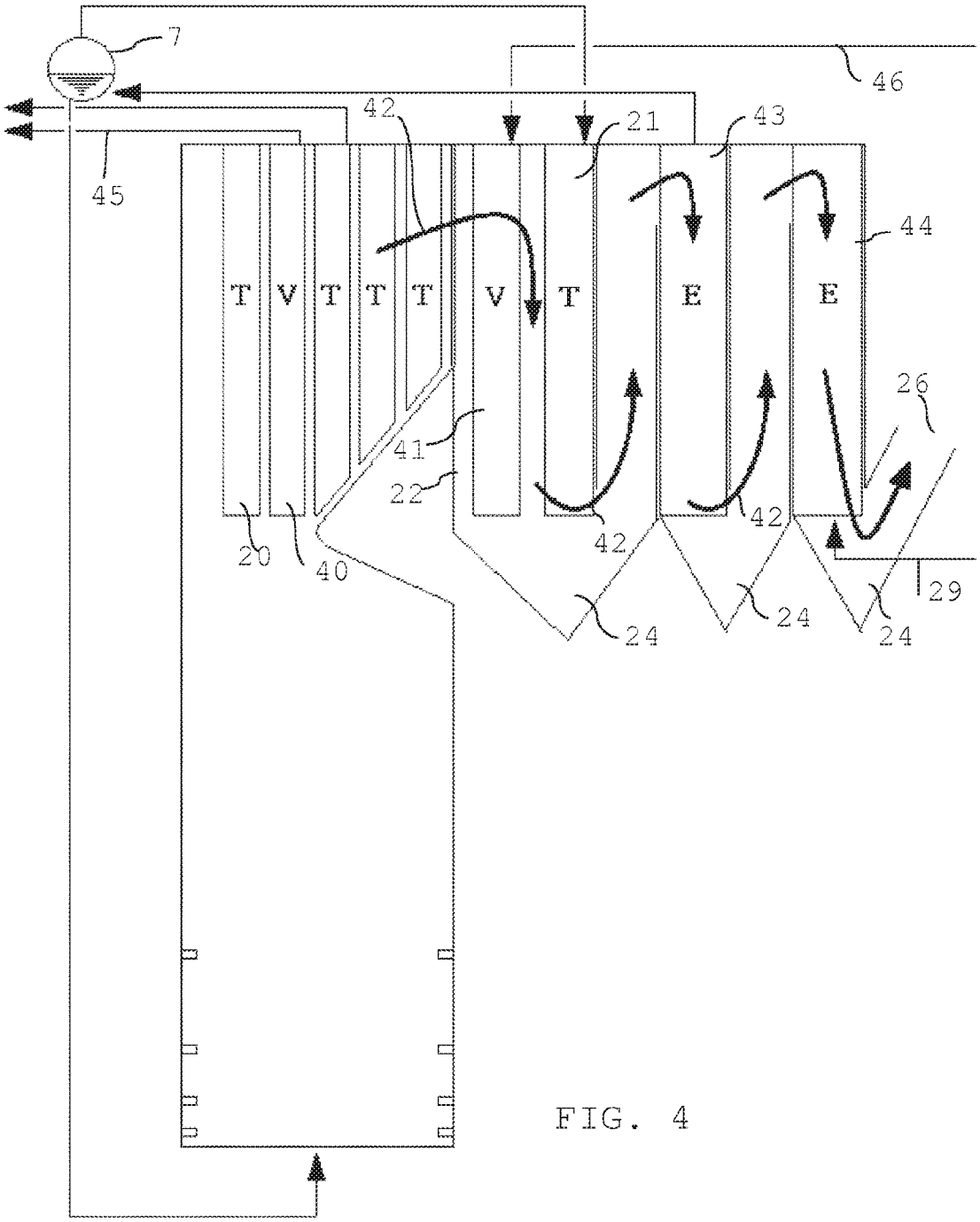
FIG. 4 illustrates a third preferred embodiment of the invention, where the so-called second pass of the flue gas duct of a chemical recovery boiler is provided with a second heat recovery unit in addition to a superheater.

The embodiment shown in FIG. 4 relates to a chemical recovery boiler with a reheater. The superheaters (T) 20 and one reheater (V) 40 are located in the upper part of the furnace. Additionally, one superheater 21 is located in the so-called second pass 22. The flue gas flows pass the superheaters 20 mainly horizontally, while in the flue gas duct the flue gas flows through vertical channels in turns from above downwards and from down upwards, as shown by arrows 42. Ash hoppers 24 are provided in the lower part of the flue gas duct.

In addition to the superheater 21, the flue gas channel, the so-called second pass, is provided with a reheater 41. In the flue gas channel 22 the flue gas flows vertically from up downwards and heats the superheater 21 and the reheater 41 simultaneously. With respect to the horizontal flow direction of the flue gas the reheater 41 and the superheater 21 are located sequentially. The superheater 21 and the economizer 41 extend typically to the whole width of the flue gas duct.

Steam enters the reheater 41 from a steam turbine (not shown), bled steam of which the reheater heats. The bled steam is led into the reheater via line 46. From the reheater 41 the steam is led into a reheater 40, after which it is returned into the steam turbine via line 45.

The flue gas flows after the second pass further through the sequential flue gas channels and exits via a discharge opening 26. The flue gas duct is additionally provided with economizers 43 and 44. The boiler water is fed into the economizers via line 29, and after it has flown counter-currently with respect to the flue gas it is led from the economizer 43 downstream of the so-called second pass into the drum 7 of the boiler.

Figure 5:
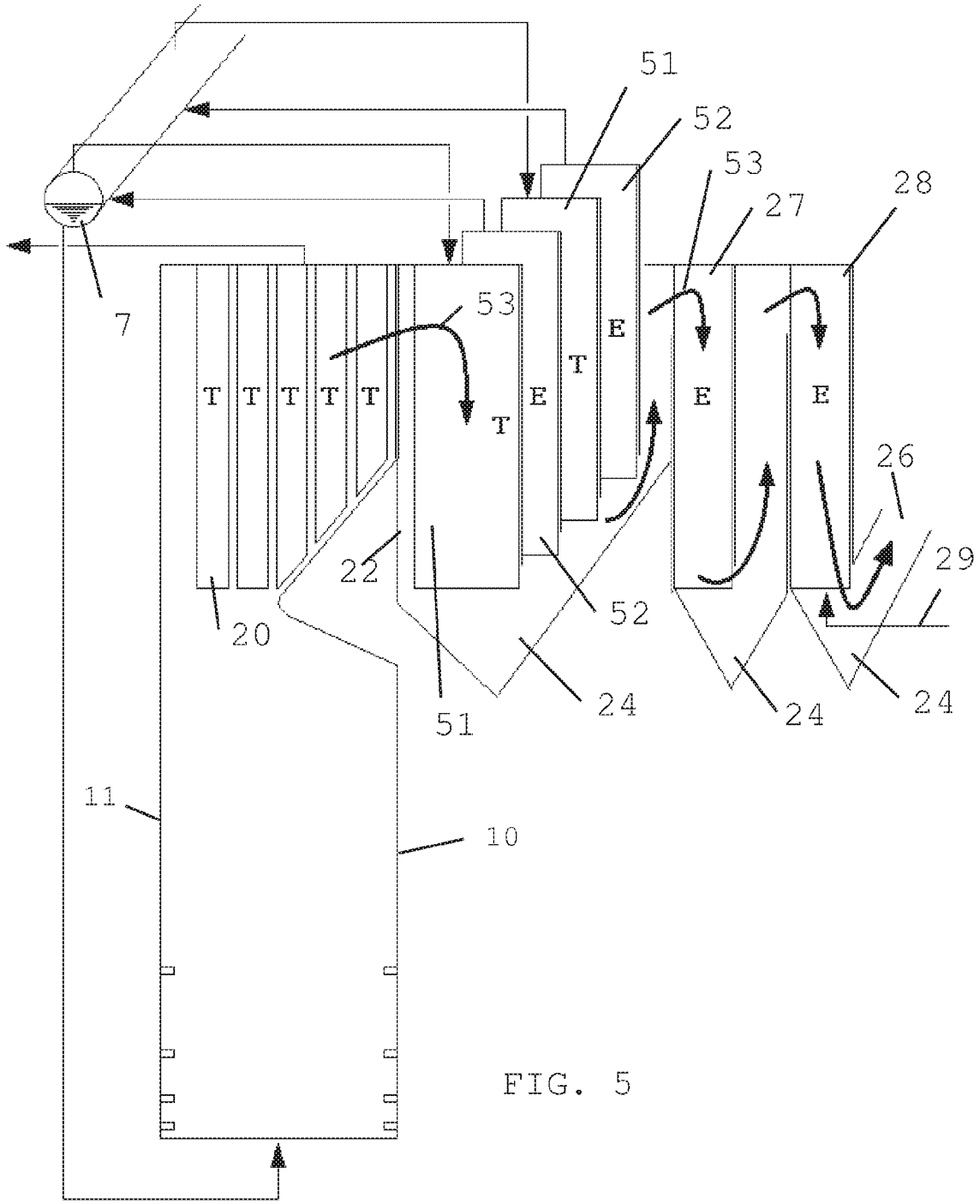
FIG. 5 illustrates a fourth preferred embodiment of the invention, where the so-called second pass of the flue gas duct of a chemical recovery boiler is provided with a second heat recovery unit in addition to a superheater.

In the embodiment of FIG. 5 the superheaters (T) 20 of the soda recovery boiler are located in the upper part of the furnace and the superheater 51 in the so-called second pass 22. The flue flows pass the superheaters 20 mainly horizontally, while in the flue gas duct the flue gas flows through vertical flue gas channels in turns from above downwards and from down upwards, as shown by arrows 53. Ash hoppers 24 are provided in the lower part of the flue gas duct.

In addition to the superheater, the so-called second pass 22 is provided with an economizer 52 so that a first flue gas channel is provided with superheater element 51 and economizer elements 52 staggered. Thus, they are positioned side by side in a row that is crosswise with respect to the horizontal incoming direction of the flue gas. It can also be said that the elements are positioned in a row in the direction of the front wall 11/rear wall 10 of the boiler. The superheater and the economizer are positioned in the second pass in parallel with respect to the downwards flowing flue gas. In FIG. 5 the heat surface elements 51 and 52 are positioned so that every second element is a superheater element 51 and every second is an economizer element 52. The positioning does not need to be symmetrical. It is also possible that the number of superheater elements is higher than the number of economizer elements or vice versa. The number and size of the elements is dependent on the required heat surface according to the structure of each boiler and the process conditions.

In the flue gas channel the flue gas flows vertically from above downwards and heats the superheater elements 51 and the economizer elements 52 simultaneously. The flue gas flows further through the sequential flue gas channels and exits via a discharge opening 26. In addition to the economizer 52, the flue gas duct is provided with economizers 27 and 28. The boiler water is fed into the economizers E via line 29, and after it has flown counter-currently with respect to the flue gas it is led from the economizer elements 52 of the so-called second pass into a drum 7 of the boiler.

When the superheater and the economizer are positioned in the second pass parallel with respect to downwards flowing flue gas, the number of their tubes can be chosen more freely, since the flue gases flow pass all the tubes. This gives an advantage when there is a need to change the mutual sizes of different heat surfaces with respect to each other and to keep the boiler building as small as possible.

Figure 6:
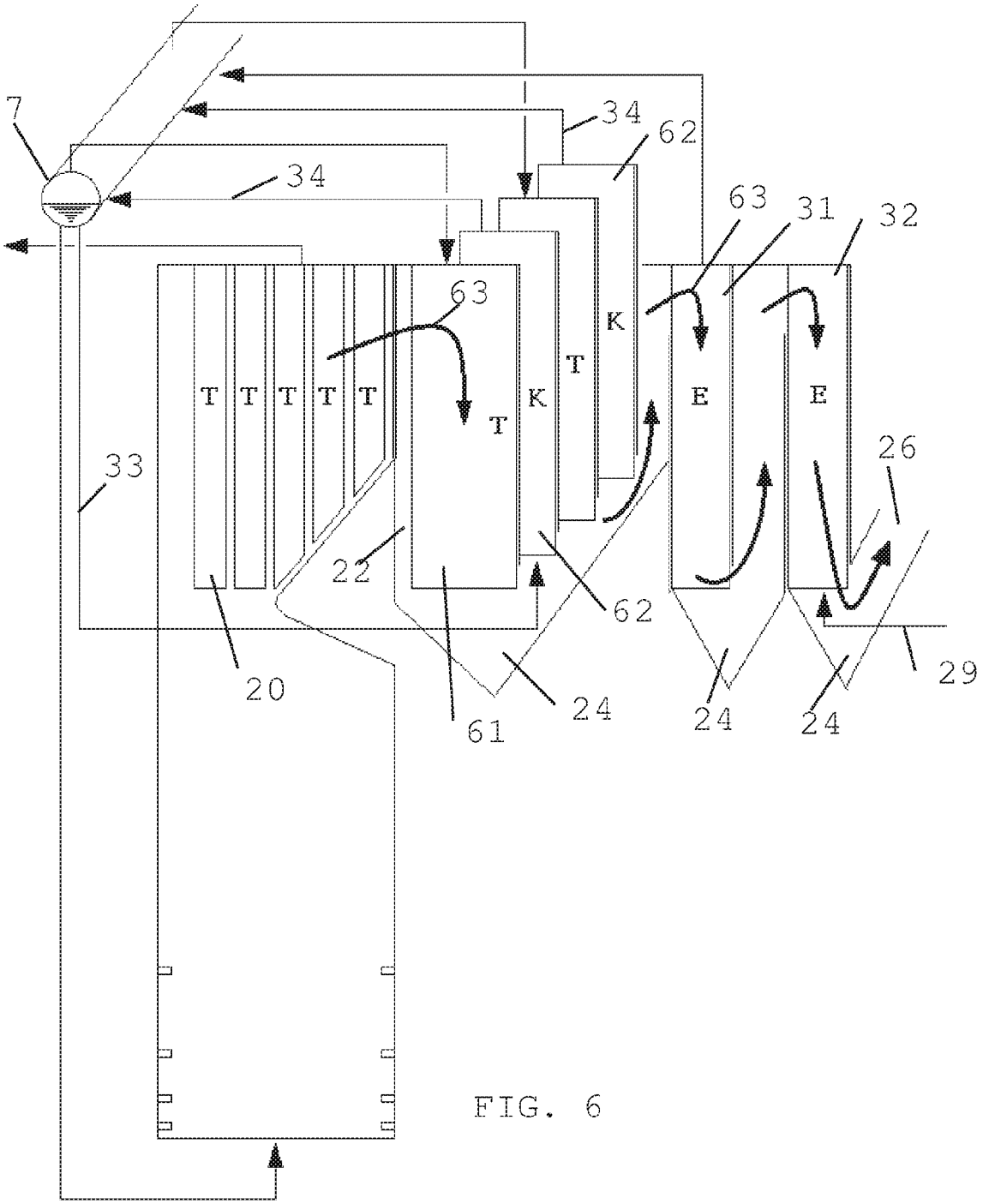
FIG. 6 illustrates a fifth preferred embodiment of the invention, where the so-called second pass of the flue gas duct of a chemical recovery boiler is provided with a second heat recovery unit in addition to a superheater.

The embodiment shown in FIG. 6 relates to a chemical recovery boiler where boiler bank is needed. The superheaters (T) (20) are located in the upper part of the furnace and the superheater 61 in the so-called second pass 22. The flue gas flows pass the superheaters 20 mainly horizontally, while in the flue gas duct the flue gas flows through vertical channels in turns from above downwards and from down upwards, as shown by arrows 63. Ash hoppers 24 are provided in the lower part of the flue gas duct.

In addition to the superheater, the so-called second pass 22 is provided with a boiler bank 62 so that a first flue gas channel is provided with superheater elements 61 and economizer elements 62 staggered. Thus, the superheater elements and the boiler bank elements are positioned side by side in a row that is crosswise with respect to the horizontal incoming direction of the flue gas. It can also be said that the elements are positioned in a row in the direction of the front wall/rear wall of the boiler. In FIG. 6 the heat surface elements 61 and 62 are positioned so that every second element is a superheater element 61 and every second is a boiler bank element 62. The positioning does not need to be symmetrical. It is also possible that the number of superheater elements is higher than the number of boiler bank elements or vice versa. The number and size of the elements is dependent on the required heat surface according to the structure of each boiler and the process conditions.

In the flue gas channel 22 the flue gas flows vertically from above downwards and heats the superheater elements 61 and the boiler bank elements 62 simultaneously. In the boiler bank elements 62 the water 33 at a saturated temperature coming from the drum 7 of the boiler is boiled partly into steam 34, which is led into the drum 7.

The flue gas flows after the second pass further through the sequential flue gas channels and exits via a discharge opening 26. The flue gas duct is additionally provided with economizers 31 and 32. The boiler water is fed into the economizers via line 29, and after it has flown counter-currently with respect to the flue gas it is led from the economizer 31 downstream of the so-called second pass into the drum 7 of the boiler.

Positioning the superheater elements and the boiler bank elements in the second pass parallel with respect to the downwards flowing flue gas provides advantages. The flue gas has in the boiler bank a certain maximum velocity, which in practice dictates the number of tubes of the boiler bank and the depth of the flue gas channel. When the boiler bank is located next to the superheater, the number of tubes in the boiler bank can be chosen more freely, since the flue gases flow also at the superheater. This provides and advantage in investment costs and electricity production in recovery boilers having a smaller need for boiler bank. The need for a boiler bank decreases at high pressure levels of live steam and at high dry solids levels of combustion liquor. The heat efficiency needed for evaporation decreases as the pressure of the steam increases, the flue gas amount decreases with dryer combustion liquor. On the other hand, the feed water needs to be heated to a higher temperature, since the higher pressure simultaneously increases the saturated temperature, whereby the size of the economizer needs to the increased.

Figure 7:
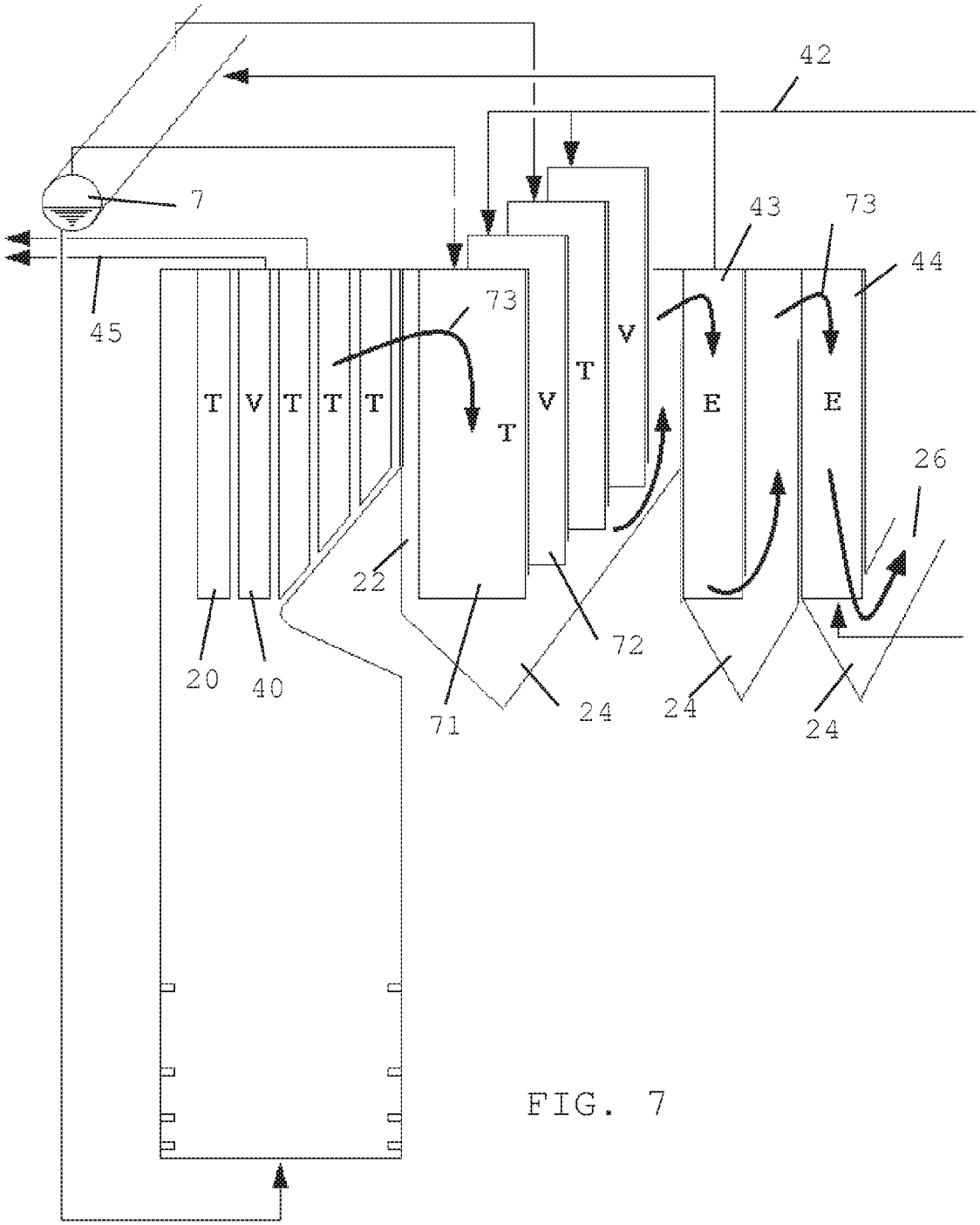
FIG. 7 illustrates a sixth preferred embodiment of the invention, where the so-called second pass of the flue gas duct of a chemical recovery boiler is provided with a second heat recovery unit in addition to a superheater.

The embodiment shown in FIG. 7 relates to a chemical recovery boiler with a reheater. The superheaters (T) 20 and one reheater (V) 40 are located in the upper part of the furnace. Additionally, a superheater 71 is located in the so-called second pass 22. The flue gas flows pass the superheaters 20 mainly horizontally, while in the flue gas duct the flue gas flows through vertical channels in turns from above downwards and from down upwards, as shown by arrows 73. Ash hoppers 24 are provided in the lower part of the flue gas duct.

In addition to the superheater, the so-called second pass 22 is provided with a reheater 72 so that the first flue gas channel is provided with superheater elements 71 and economizer elements 72 staggered. Thus, the superheater elements and the reheater elements are positioned side by side in a row that is crosswise with respect to the horizontal incoming direction of the flue gas. It can also be said that the elements are positioned in a row in the direction of the front wall/rear wall of the boiler. In FIG. 7 the heat surface elements 71 and 72 are positioned so that every second element is a superheater element 71 and every second is a reheater element 72. The positioning does not need to be symmetrical. It is also possible that the number of superheater elements is higher than the number of reheater elements or vice versa. The number and size of the elements is dependent on the required heat surface according to the structure of each boiler and the process conditions.

In the flue gas channel 22 the flue gas flows vertically from above downwards and heats the superheater elements 71 and the reheater elements 72 simultaneously. Steam enters the reheater 72 from a steam turbine (not shown), bled steam of which the reheater heats. The bled steam is led into the reheater elements via line 42. From the reheater elements 72 the steam is led into a reheater 40, after which it is returned into the steam turbine via line 45.

The flue gas flows after the second pass further through the sequential flue gas channels and exits via a discharge opening 26. The flue gas duct is additionally provided with economizers 43 and 44. The boiler water is fed into the economizers via line 29, and after it has flown countercurrently with respect to the flue gas it is led from the economizer 43 downstream of the so-called second pass into the drum 7 of the boiler.

Although the above description relates to embodiments of the invention that in the light of present knowledge are considered the most preferable, it is obvious to a person skilled in the art that the invention can be modified in many different ways within the broadest possible scope defined by the appended claims alone.

The invention claimed is:

1. An arrangement in a chemical recovery boiler having a furnace for combusting waste liquor and a flue gas duct comprising:

vertical flue gas channels, at least part of which are provided with heat recovery units for recovering heat from flue gases, said heat recovery units each having a width of substantially that of the flue gas duct, wherein the vertical flue gas channels include a first flue gas channel after the furnace, and within the first flue gas channel are at least two of the heat recovery units which include a superheater and a secondary heat recovery unit, and the first flue gas channel further includes an open gas passage downstream in a flow of the flue gasses through the first flue gas channel, wherein the flue gases flow upward through the open gas passage to an upper outlet of the first flue gas channel, and the flue gases flow from the upper outlet to a next one of the vertical flue gas channels;

wherein the secondary heat recovery unit is at least one of an economizer, a boiler bank and a reheater, wherein the superheater and the secondary heat recovery unit are positioned within the first flue gas channel one after the other along a horizontal incoming direction of the flue gas such that the flue gas flows downward through the first flue gas channel and thereby heats the superheater and the secondary heat recovery unit simultaneously, and wherein the secondary heat recovery unit is disposed entirely within the first flue gas channel.

2. The arrangement according to claim 1, wherein the secondary heat recovery unit is the economizer and, in the first flue gas channel, the superheater is forward of the economizer along the horizontal direction.

3. The arrangement according to claim 1, wherein the secondary heat recovery unit is the boiler bank, and, in the first flue gas channel, the superheater is forward of the boiler bank along the horizontal direction.

4. The arrangement according to claim 1, wherein the secondary heat recovery unit is a reheater and, in the first flue gas channel, the superheater and the reheater are arranged one after the other along the horizontal direction.

5. The arrangement according to claim 1, wherein the first flue gas channel includes wall tubes connected to a dedicated tube circulation system which includes a drum of the boiler for providing a steam/water mixture flow in the wall tubes, and the wall tubes are not a part of the superheater and the secondary heat recovery unit.

6. The arrangement according to claim 1, wherein the first flue gas channel includes wall tubes connected to the superheater to provide a steam flow through the wall tubes, and the wall tubes are not a part of the superheater and the secondary heat recovery unit.

7. An arrangement in a chemical recovery boiler having a furnace for combusting waste liquor and a flue gas duct comprising vertical flue gas channels, at least part of which are provided with heat recovery units for recovering heat from flue gases, wherein said heat recovery units comprise heat surface elements, wherein within a first flue gas channel after the furnace are a superheater and a secondary heat recovery unit, an open gas passage and an upper outlet, such that the flue gasses flow through the first flue gas channel sequentially downwards through the superheater and the secondary heat recovery unit, upward through the open gas passage, and through the upper outlet to a next one of the vertical flue gas channels, wherein the secondary heat recovery unit is at least one of: an economizer, a boiler bank and a reheater, and heat surface elements of the superheater are positioned side-by-side with heat surface elements of the secondary heat recovery unit along a direction transverse to a horizontal incoming direction of the flue gas, and the heat surface elements of the superheater and the heat surface elements of the secondary heat recovery unit are positioned parallel to a flow of the flue gas flowing in the first flue gas channel such that flue gas heats the superheater and the secondary heat recovery unit simultaneously, wherein the secondary heat recovery unit is disposed entirely in the first flue gas channel.

8. The arrangement according to claim 7, wherein the secondary heat recovery unit includes the economizer.

9. The arrangement according to claim 7, wherein the secondary heat recovery unit includes the boiler bank.

10. The arrangement according to claim 7, wherein the secondary heat recovery unit includes the reheater.

11. The arrangement according to claim 7, wherein the first flue gas channel includes wall tubes configured to receive a steam/water mixture flow and the wall tubes are not part of the superheater and the secondary heat recovery unit.

12. The arrangement according to claim 7, wherein the first flue gas channel includes wall tubes, and the superheater and the secondary heat recovery unit are not part of the wall tubes.

13. A chemical recovery boiler comprising:

a furnace configured to combust waste liquor and direct flue gases upward;

a bank of superheaters arranged in an upper region of the furnace;

a flue gas duct adjacent and horizontally offset from the bank of superheaters, wherein the flue gas duct is configured to receive the flue gasses flowing from the bank of superheaters and the flue gas duct includes:

flue gas channels arranged vertically in the flue gas duct and each of the flue gas channels having an upper inlet configured to receive the flue gasses, an ash hopper at a bottom portion of the flue gas channel, a heat recovery unit oriented vertically in the flue gas channel, and an open gas passage extending from the ash hopper to an upper outlet of the flue gas channel, wherein the heat recovery unit is upstream of the open gas passage along a gas path through the flue gas channel; and a first flue gas channel of the flue gas channels having the upper inlet to receive the flue gasses directly from the bank of superheaters and wherein the heat recovery unit in the first flue gas channel includes a superheater and a secondary heat recovery unit which is at least one of an economizer, a boiler bank and a reheater;

wherein the gas path through the first flue gas channel flows simultaneously through the superheater and the secondary heat recovery unit, and wherein the secondary heat recovery unit is disposed entirely within the first flue gas channel.

14. The chemical recovery boiler of claim 13 wherein in the first flue gas channel the superheater is nearer to the bank of superheaters than the secondary heat recovery unit.

15. The chemical recovery boiler of claim 13 further comprising a steam drum and wherein, in the heat recovery unit of the first flue gas channel, the secondary heat recovery unit has a water inlet coupled to a water outlet of the steam drum, and a steam outlet of the superheater is configured to provide steam for a steam turbine.

16. The chemical recovery boiler of claim 13 further comprising a steam drum and wherein, in the heat recovery unit of the first flue gas channel, the secondary heat recovery unit has a steam or water outlet coupled to a steam or water inlet to the steam drum, and a steam outlet of the superheater is configured to provide steam for a steam turbine.

17. The chemical recovery boiler of claim 13 wherein the heat recovery unit for each of the flue gas channels spans a width of the flue gas duct.

18. A chemical recovery boiler comprising:

a furnace configured to combust waste liquor and direct flue gases upward, wherein vertically oriented walls of the furnace include wall tubes;

a bank of superheaters arranged in an upper region of the furnace;

a steam drum external to the furnace and having an outlet for water which provides water for the wall tubes;

a first flue gas channel adjacent and offset along a horizontal direction from the bank of superheaters, wherein the first flue gas channel is oriented vertically, is defined by walls of the first flue gas channel, has an upper inlet configured to receive the flue gases flowing from the bank of superheaters, has an upper outlet for the flue gasses and has a bottom ash hopper;

a heat recovery unit entirely disposed within a region of the first flue gas channel in which the flue gasses flow downward from the upper inlet towards the bottom ash hopper, wherein the heat recovery unit is separate from the walls of the first flue gas channel and spans a width of the first flue gas channel and the heat recovery unit includes a superheater and a secondary heat recovery unit which is at least one of an economizer, a boiler bank and a reheater and wherein the first flue gas channel is configured to guide flue gases simultaneously through the superheater and the secondary heat recovery unit; and wherein the first flue gas channel includes an open gas passage in which the flue gasses flow from the heat recovery unit in an upward direction to the upper outlet, and a second flue gas channel oriented vertically and having an upper inlet configured to receive the flue gasses flowing from the upper outlet of the first flue gas channel.

19. The chemical recovery boiler of claim 18, wherein the walls of the first flue gas channel include wall tubes configured to receive a steam and water mixture flow, and the wall tubes of the first flue gas channel are not a part of the superheater and the secondary heat recovery unit.

* * * * *